United States Patent [19]

Annable

[11] 4,121,434

[45] Oct. 24, 1978

[54] RADIATION SHIELDING MEANS FOR RADIANT COOLERS

[75] Inventor: Richard V. Annable, Fort Wayne, Ind.

[73] Assignee: International Telephone & Telegraph Corp., Nutley, N.J.

[21] Appl. No.: 693,030

[22] Filed: Jun. 4, 1976

[51] Int. Cl.[2] ..... F25B 19/00

[52] U.S. Cl. ..... 62/467 R; 62/514 R; 62/DIG. 1; 62/DIG. 9

[58] Field of Search ..... 62/467, 514, DIG. 1, 62/DIG. 9; 165/133; 250/352, 338; 356/51

[56] References Cited

U.S. PATENT DOCUMENTS

| | | | |
|---|---|---|---|
| 3,224,220 | 12/1965 | Mills | 62/467 |
| 3,310,102 | 3/1967 | Trombe | 62/467 |
| 3,324,940 | 6/1967 | Grimm | 165/133 |
| 3,422,886 | 1/1969 | Buller | 62/467 |
| 4,030,316 | 6/1977 | Aronson | 62/467 R |

*Primary Examiner*—Lloyd L. King

*Attorney, Agent, or Firm*—John T. O'Halloran; Alfred C. Hill

[57] ABSTRACT

The improved passive radiation shielding means for radiant coolers as illustrated and described herein involves a device wherein one or more radiation shields having open, externally viewing end areas are positioned in a housing between stages of a radiant cooler. Mechanical low conductive supports hold the various elements, including the device to be cooled, the cooling stages and the radiant shields in place. In one practical embodiment of the device of this invention for use in cooling detector means aboard a satellite, the housing includes first radiant cooler stage is composed of a radiator surface, an optically polished and aluminized cone, two gold plated radiation shields and eight tubular low conductance insulating supports which mount the first stage to the vacuum housing. In addition there is hinged earth shield which may be deployed on command, whether the device is being tested or its in position in orbit. The second stage is made up of the patch, the detector package, two gold plated radiation shields and four tubular low conductance insulating supports which mount this assembly to the first stage of the cooler.

8 Claims, 10 Drawing Figures

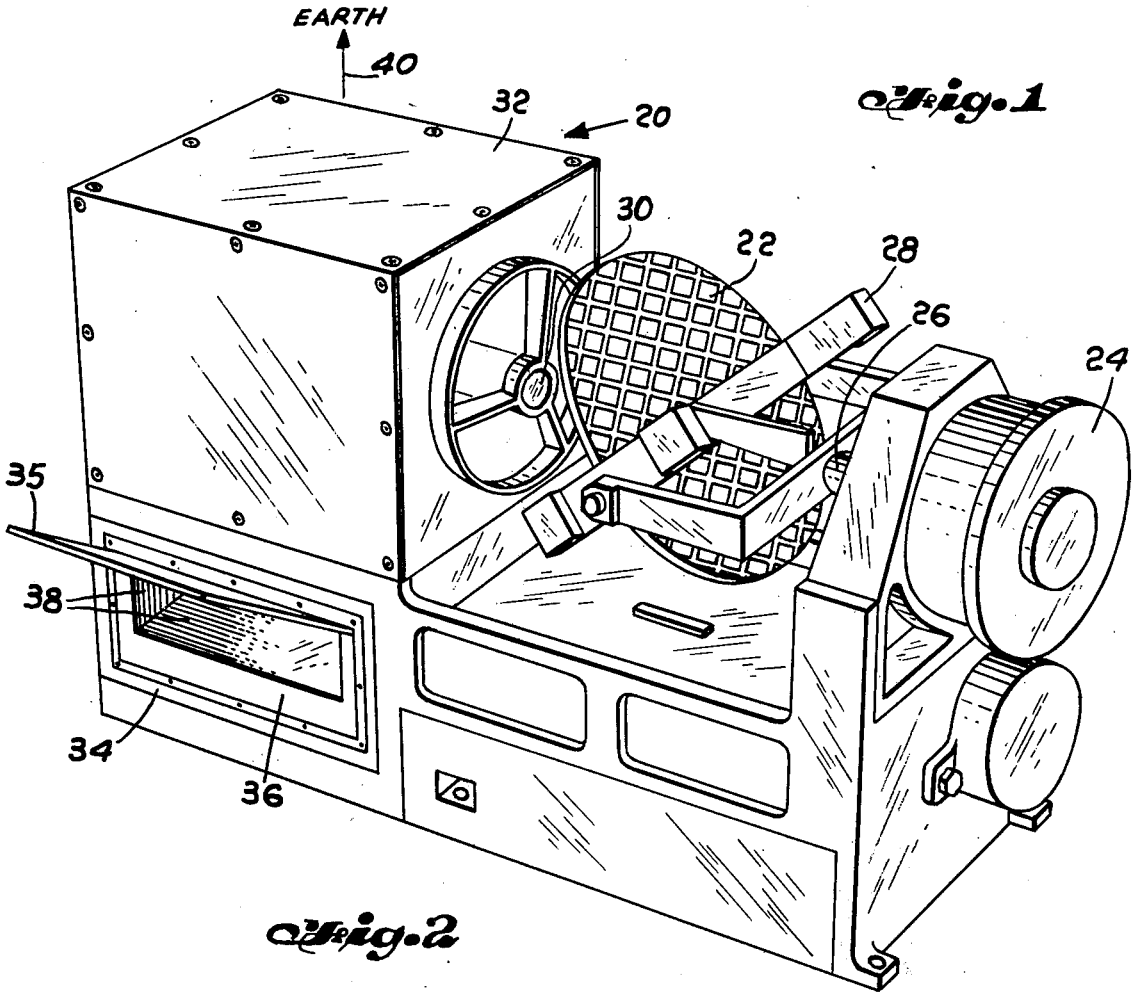
Fig. 1
Fig. 2
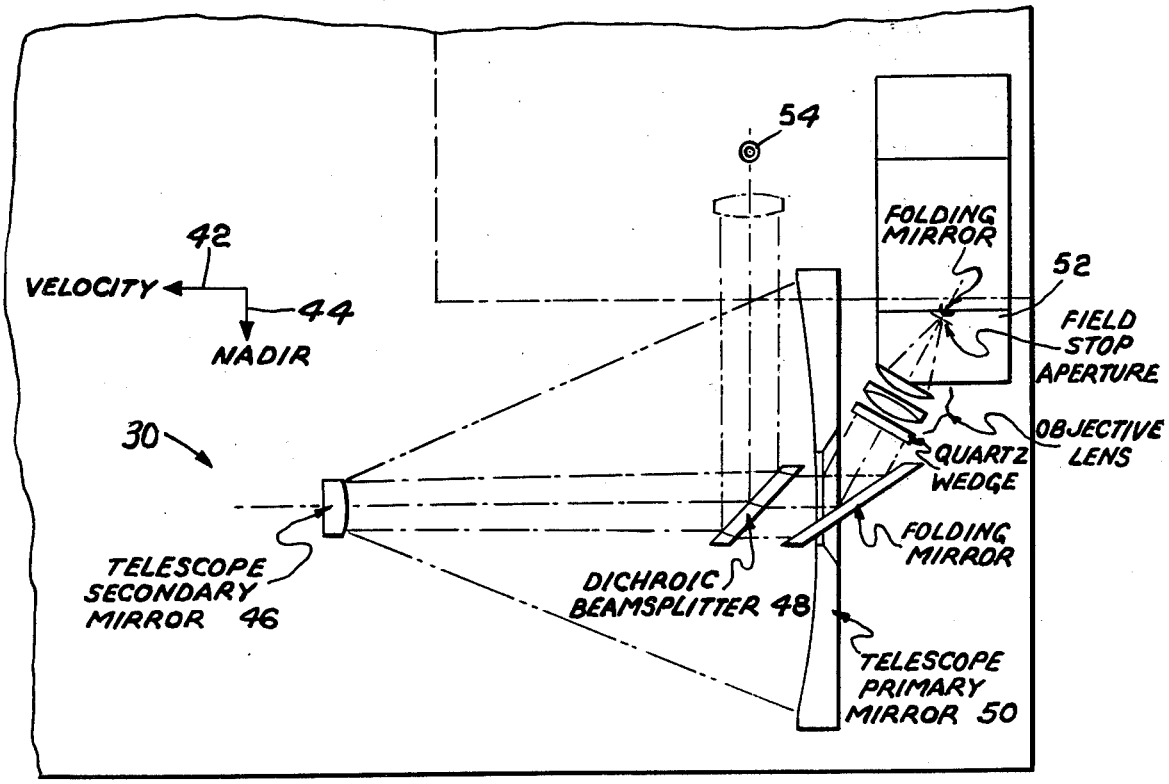

SECOND STAGE 58
RADIATION SHIELD
COLD TRAP 86
THERMAL ISOLATOR & HEATER 88
72
82
84
80
68
78

SUPPORT 66
VACUUM HOUSING 68
RADIATION SHIELDS 64
6
72
74
66
56
58
FIRST STAGE RADIATOR 60
CONE MIRROR 62 (OPTICAL FINISH, ALUMINIZED)
SECOND STAGE 70
DETECTOR PACKAGE
EARTH SHIELD DOOR 35
EARTH

RADIATION SHIELDING MEANS FOR RADIANT COOLERS

BACKGROUND OF THE INVENTION

1. Field:

This invention relates to the field of radiant coolers and specifically for improved radiation shielding systems for such radiant coolers.

2. Prior Art:

The radiation shielding system of this invention is utilized to replace a multi-layer insulation blanket. Passive radiation coolers have been known in the past which utilize multi-layer insulation blanket systems much in the same fashion as such have been utilized in cryogenic applications. The utilization of multi-layer systems known in the prior art is disclosed in the following references: "Multiple Layer Insulation for Cryogenic Applications" (R. H. Kropschot, Cryogenics, March 1961, P. 171) and "Effective Thermal Insulation Multilayer Systems" (P. E. Glaser, Cryogenic Engineering News, April 1969, p. 16). A similar review is given by Kropschot in Chapter 6 of *Applied Cryogenic Engineering* (ed. by R. V. Vance and W. M. Duke, Wiley, 1962).

Multilayer insulation blanket systems achieve large, 100 or greater, insulation factors when the end and penetration effects are small. This is generally the case when the scale is large or the insulated volume forms a closed surface. For example, degrading effects are small in an insulation blanket for a space craft or for large cryogenic storage containers. When applied to passive radiant coolers, however, the multilayer insulation blanket necessarily does not cover a closed volume, the scale is relatively small and the end effects are significant.

The multilayer blankets used in radiant coolers associated with space satellites usually consists of sheets of polyester aluminized on both sides and separated by one or two layers of low conductivity silk or polyester mesh. In some insulations there is no low conductivity separation. Instead the aluminized reflectors are kept apart by distorting the reflecting surfaces to obtain only point contacts between the layers.

It has been found in practice that multilayer blankets are degraded by their open end areas, which of course increases with the number of layers, by penetrations with supports for the blanket and by compression of the layers. While such systems have measured insulation factors in the range of 60 to 80 and, while it may be possible to reach an insulation factor of 100, it is highly unlikely in view of the drawbacks to such devices that they can be effective to achieve insulation factors as high as 100.

In addition there are significant outgassing and contamination problems which may result in degradation of such systems' performance.

SUMMARY OF THE INVENTION

A multistage passive radiant cooler which eliminates the need for multilayer blankets is disclosed wherein spaced radiation shields are utilized. The first stage of the radiant cooler has a radiator surface associated with an optically polished cone directed to outer space, two gold plated radiation shields supported on tubular low conductivity insulating supports which join the elements to the housing of the cooler. The first stage also includes a hinged earth shield. A second stage made up of a patch, the detector package, two gold plated radiation shields carried on low conductivity tubular insulator supports which mount the second stage to the first stage of the cooler. The gaps between each of the ends of the radiation shields are directed towards outer space thus simplifying outgassing and making reduction of contamination considerably easier.

An experimental model illustrating in the basic principles of the device of this invention is described and the comparison between calculated and measured cooling performance characteristics is determined. In the experimental model, a first cooling stage and a second cooling stage are separated from each other by a space which includes a pair of radiation shields with low conductivity tubular supports joining first and second cooler stages, radiation shields and the experimental patch area together. A simulated cold space target is positioned outside of the second stage and the entire structure is carried within the vacuum housing. The experimental model, both in a simplified form and a slightly more complex form, illustrate the basic principles of the structure of this invention and the increased insulation factor which can be obtained in a rugged construction which eliminates the difficulties encountered with multilayer insulation blankets.

The means of obtaining high insulation factors with the device of this invention depends upon the following three conditions. To apply the shielding means to radiant coolers, the first two must be applied and to usual conditions all three should be applied.

First of the conditions is that the shields must be mechanically attached utilizing low conductance supports. This is a basic condition because it introduces no additional thermal conductance from the addition of the thermal radiation shields (in contrast with multilayer blankets, the shields are purely radiative in terms of thermal exchange with their surroundings). It will be appreciated by those versed in this art that when the supports are divided into equal segments by the shields and the bounding surfaces, that the shields act as a set of ideal, floating radiative shields. This conclusion is supported by the analysis given below as a part of the description of the experimental model. This result applies when the surfaces are of infinite extent or when they form a closed surface such as a sphere.

The second of the conditions is the presence of open, externally viewing end areas. The non-closure of the thermal shields is a necessary condition for the use of a radiant cooler. In the improved shielding means of this invention this is put to advantage by reducing the view factor and therefore the radiative heat interchange between adjacent shields and between the outer shields and their bounding (cooler stage) surfaces.

The third condition relates to the emissivity of the end areas. Under usual conditions (i.e., not always but most of the time,) the insulation factor can be further increased by making the externally viewing end areas have a high effective emissivity for emission to the outside. This provides cooling of the shields by the radiative means that is basic to the radiant cooler itself. The high emissivity is achieved by painting the external ends of the shields themselves black and by slanting or otherwise modifying the space between shields so that this space appears black from the outside, i.e., forms a black cavity.

BRIEF DESCRIPTION OF THE DRAWINGS

FIG. 1 is a persepctive drawing of an instrument which includes the device of this invention;

FIG. 2 is a schematic of the optic system in an instrument utilizing the device of this invention;

DESCRIPTION OF THE PREFERRED EMBODIMENT

Figure 3:
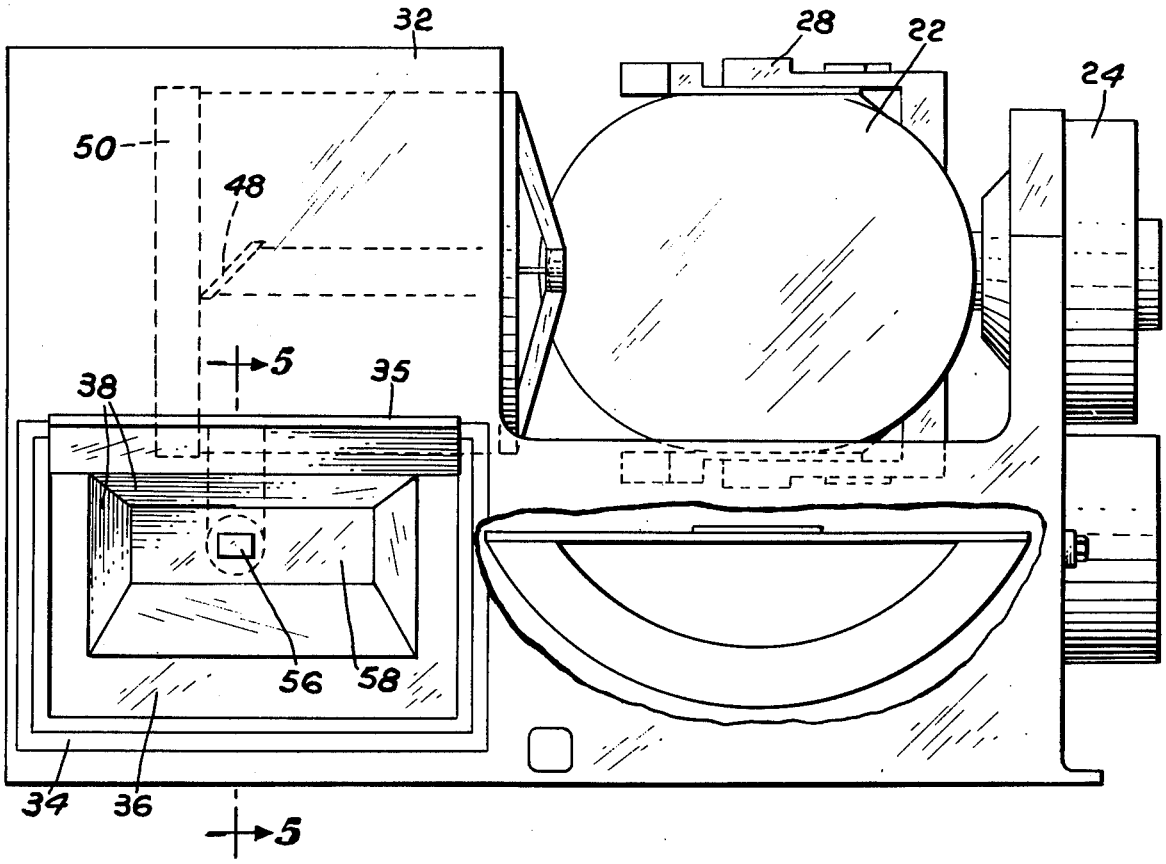
FIG. 3 is a top view of the instrument illustrated in FIG. 1 including the device of this invention.

Referring to the Figures for purposes of illustration, the device of this invention is illustrated as being a part of a satellite carried high resolution radiometer illustrated generally at 20 in FIG. 1. The instrument 20 utilizes a continuously rotating mirror 22 for scanning the earth. The mirror 22 is direct driven by a hysteresis synchronous motor. The mirror 22 is gimbaled to the motor shaft 26 by gimbal arrangement 28. Energy from the scan mirror 22 is collected by "a mersenne" (a focal) telescope 30 which will be further described in connection with FIGS. 2, 3 and 4 below.

All of the elements of the instruments are carried in a housing 32 which includes the device of this invention, the radiation cooler and its improved thermal radiation shields, to be described in detail below is illustrated generally as being carried in the housing 32 in the general area designated 34. An earth shield 35 is shown along with a portion of the first stage radiator 36 and reflective shields 38. As illustrated in FIG. 1, the earth shield 35 is in its open position, or its operating position. The orientation of the device 20 illustrated in FIG. 1 is such that the direction toward the earth indicated by the arrow 40 is maintained throughout the operational life of the instrument.

In order to understand the optics of the device of this invention, FIG. 2 illustrates schematically the optical system utilized in connection with the device of this invention. The directions of the velocity of the spacecraft and its nadir are illustrated by arrows 42 and 44 respectively. The incoming light from the telescope 30 (elements of which are shown generally in FIG. 2) is received by a telescope secondary mirror 46 which directs it to a dichoric beam splitter 48. Energy from the telescope's primary mirror 50 in conjunction with the secondary mirror 46 produces a colimated beam focused on the dichoric beam splitter 48. The purpose of the dichoric beam splitter 48 is to separate the long wave infra-red energy (IR) from the shorter wavelengths directing it toward the IR optics into the radiant cooler where it is focused on a photodetector, preferably of the HgCdTe type. The visible and near IR energy is passed through the beam splitter 48 and is brought to focus at the entrance aperture of an "Ebert spectrometer" illustrated generally at 52. The spectrometer 52 performs the final spectral separation of the energy and focuses it on a five element silicon detector array contained within an optics package 52.

Figure 4:
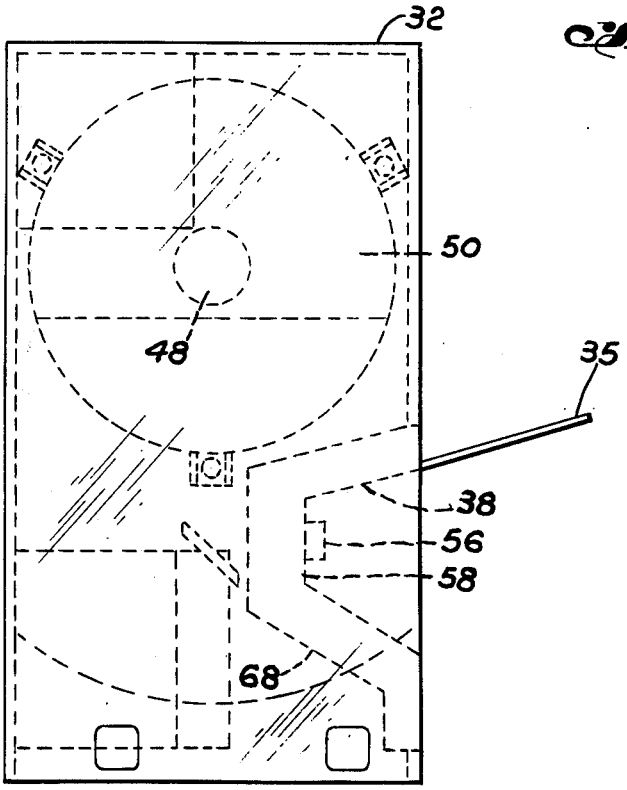
FIG. 4 is an end view of the instrument illustrated in FIG. 3.

Referring to FIGS. 3 and 4, for the general arrangement and positioning of the parts, it will be seen that with the earth shield 35 in the open or operative position, the passive radiator indicated generally at 34 has cone walls or reflective shields 38 and a patch area 58 on which is mounted the optics package 56.

It is well known in the art that infra-red detection devices require cooling for optimum operation. In the past it has been common practice to provide such cooling by the so-called gas cryostat. Reference to discussions concerning the prior art devices may be found in U.S. Pat. No. 3,025,680 which issued to the assignee of the present invention.

The radiation cooler 34 as illustrated in the Figures of this invention is an improved version of prior art coolers which exhibits improved thermal performance, better contamination control and good mechanical stability. The last of these is a necessity if good registration is to be maintained between the infra-red and visible channels. The devices in general are classified as a passive cooling device for multiple detectors or it may be utilized as illustrated in the Figures as a device for a single detector 54. While illustrated in connection with the instrument 20, in order to provide the proper environment and setting for the radiation cooler of this invention, it can be appreciated that the details of the operation of the entire instrument 20 are for purposes of illustration only and the radiant cooler module as illustrated in FIG. 1 and following could be utilized in any situation where radiant cooling is desirable. It is particularly useful aboard satellites where the detectors must be cooled. It is well understood in the art that a passive radiation cooler is one which utilizes no cryogenic fluids but instead relys on radiation of the heat energy produced by the detector to deep outer space which is nominally at a temperature 4K.

Figures 5, 9:
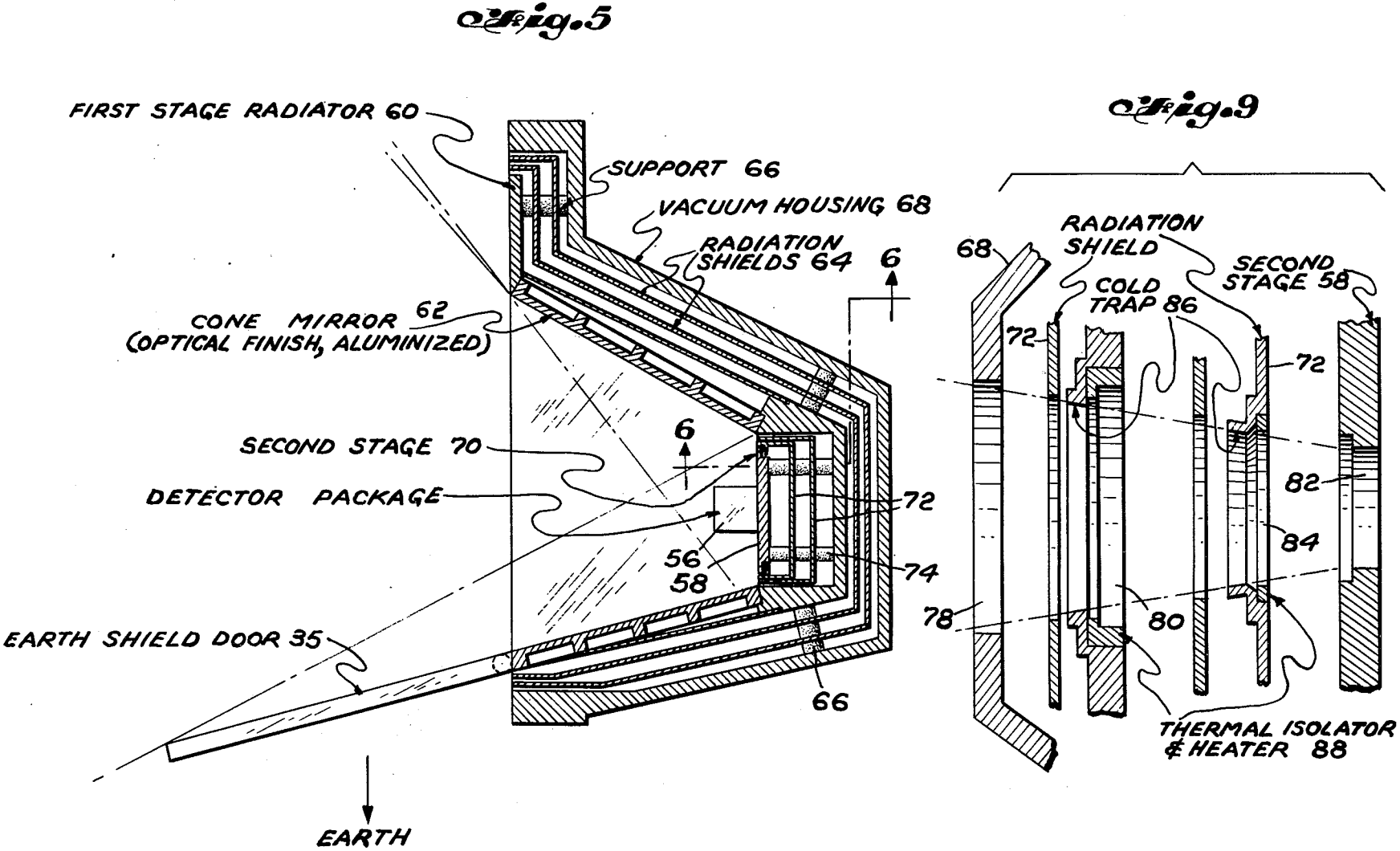
FIG. 5 is a side view in cross-section illustrating the device of this invention taken on the lines 5—5 of FIG. 4.
FIG. 9 is a partial cross-sectional view illustrating the positioning of the elements and their relationships to each other utilizing the device of this invention.

Referring now to FIG. 5, a cross sectional view of the radiant cooler 34 of this invention is designed to show the various components which make up the assembly 34. The first stage 36 is composed of a radiator surface 60, an optically polished and aluminized cone 62, two gold plated radiation shields 64 and eight tubular insulating supports 66 which mount the first stage 36 to a vacuum housing 68. Also considered to be a part of the first stage 36 is the hinged earth shield 35. The earth shield 35 is driven by a stepper motor and a positive drive re-enforced polyurethane belt (not shown) so that it may be deployed on command in a chamber for testing or when the device is in orbit. The specific manner of operation of the shield 35 is old in the art and not illustrated in detail because it forms no part of this invention. It is to be understood that in the art the nonmetallic belt which operates the shield 35 provides thermal isolation between the mounting structure and the first stage 36 of the radiant cooler 34.

Figure 8:
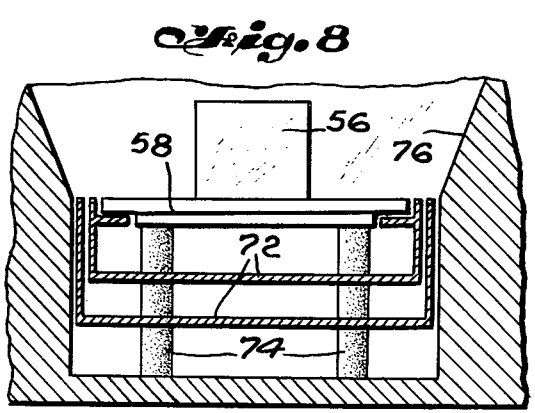
FIG. 8 is a partial side view in cross section taken along lines 8—8 of FIG. 6.
Figure 6:
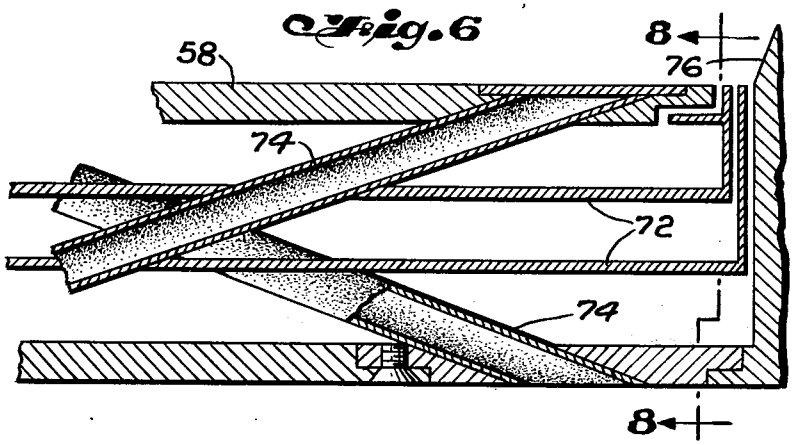
FIG. 6 is a cross-sectional view taken along lines 6—6 of FIG. 5.
Figure 7:
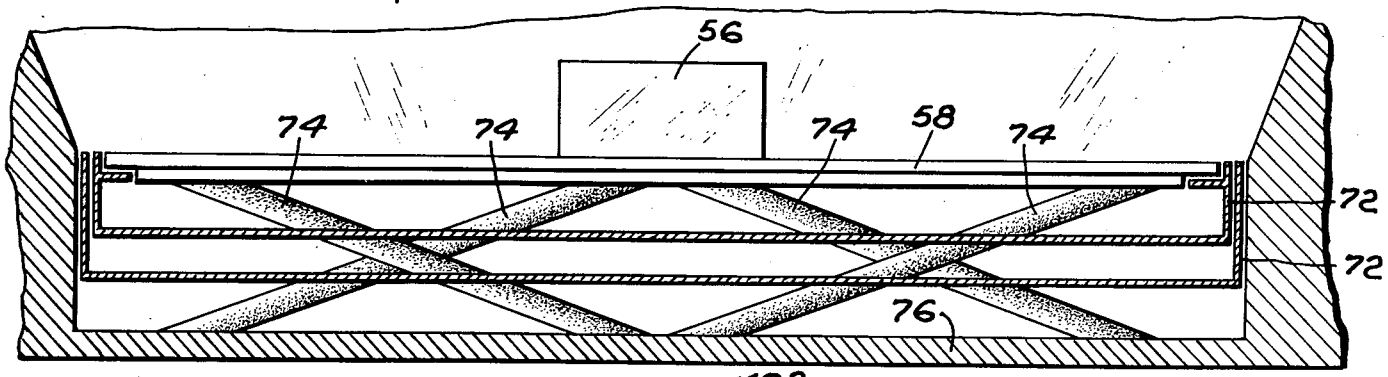
FIG. 7 is a cross-sectional top view of the device illustrated in FIG. 5.

The second stage indicated generally at 70 is made up of patch 58, the detector package or optics package 56 two gold plated radiation shields 72 and four tubular insulating supports 74 which mount the second stage assembly to the first stage 36 of the radiation cooler 34 on the element 46 which forms a portion of the first stage of the cooler of this invention. Details of the mounting arrangement between the patch 58 and the tubular supports which interconnect to the member 76 are illustrated in FIGS. 6, 7 and 8. It will be seen that each of the four tubular supports 74 interconnect the patch 58 to the first stage member 76 in the fashion illustrated and, at the same time, support the radiation shield 72.

It will be understood that the instrument mounting base (not shown) serves as a rigid unit to which the elements of the instrument are fixed. It is to also be understood that the entire unit is carefully manufactured to assure the accuracy of the critical mounting surfaces. The scan assembly illustrated in FIG. 1, elements 22, 24, 26, 28 also includes a momentum compensator (not shown) the telescope 30 and the spectrometer 52 as well as the radiant cooler 34, the IR optics and the calibration target (not shown), all attach directly to the frame. Suitable electronic modules will be provided as part of the overall instrument. Since the electronics are well known in the art there is no need to discuss them in any detail here. The frame of the instrument is to be mounted directly to a weather or other type of satellite.

It will be appreciated that as illustrated in FIG. 9 there must be windows, skirts and openings acting as optical ports to the second stage 58 of the device as illustrated in FIG. 5. In FIG. 9, the relative position of the windows 78, 80, 82 and 84 are illustrated along with cold traps 86 and thermal isolator and heaters 88.

In general the radiant cooler 34 of this invention provides many advantages over prior art devices particularly those utilizing multilayer insulation. By virtue of the improvements in the area of thermal performance and capacity, as well as contamination control and mechanical stability, the device of this invention offers advantages in the nature of 5 to 1 over prior art devices. The second or inner stage (patch 58) is designed to operate at a control temperature in the 105K to 110K range and has a radiating area which is approximately 2½ times that of prior art patches. The larger area of the patch 58 is a direct result of the utilization of thermally isolated first stage which restricts the view of the second stage as well as shading the first stage. Although the patch 58 is larger than the prior art device the improved cooler 34 of this invention occupies less instrument volume than prior art devices.

The cooler housing 68 is at the temperature of the main housing 32 (i.e., there are truly only two stages of cooling). As a result the cooler of this invention may be positioned at any convenient position within the total instrument package 20. Accordingly in the device as illustrated, it is oriented in the instrument so that the cooler has greater sun shading by the spacecraft structure at $\gamma$ angles above 0°. As compared to prior art devices the device of this invention replaces the very small view of the solar panel present in the prior art device by an even smaller view of the spacecraft. In this new position this has permitted the deletion of two sun-shields which were necessary parts of the prior art device.

A significant change in the design illustrated in the Figures is the elimination of all multilayer insulation. This modification produces improvements in all three of the areas mentioned above. The insulation factor of the multiple metallic radiation shield used for radiative decoupling is greater than that obtainable from a multilayer blanket. Furthermore elimination of the multilayer blanket also removes the major source of contamination within the cooler itself. Additionally the radiation shields are equally spaced on and interconnect the mechanical supports between the stages. This not only strengthens the support structure but also allows for greater accuracy in the assembly of the cooler and the alignment of the optical elements within the cooler.

Figure 10:
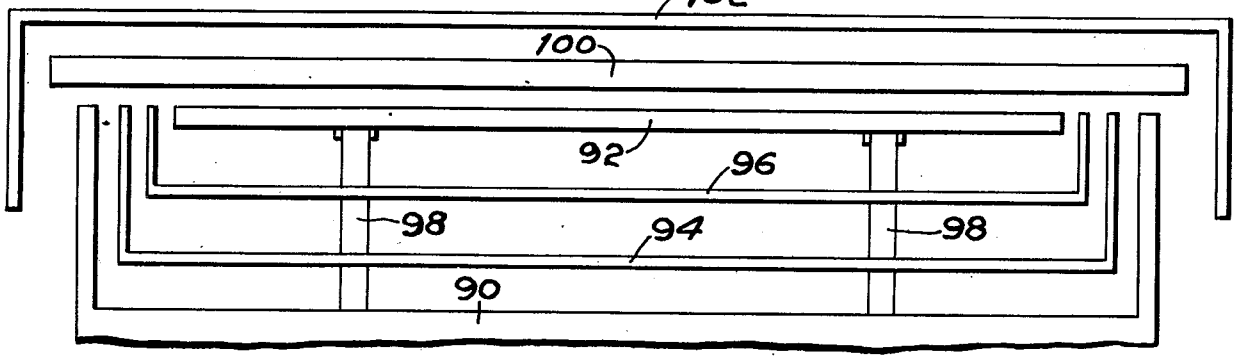
FIG. 10 is a schematic of the elements of the device of this invention illustrating the basic principles involved.

Illustrated in FIG. 10 is an experimental model of the device of this invention which was constructed for test purposes in order to illustrate the principles of this invention. In the device illustrated in FIG. 10, the first or outer stage 90 is associated with an inner stage 92. A pair of radiation shields 94, 96 are provided which are supported by tubular supports 98 interconnected between the outer stage 90 and the inner stage 92. A simulator target or space target 100 is provided. In addition a shroud 102 is positioned as indicated. For the purposes of demonstrating the effectiveness of the principles of the invention the target 100 was operated at a temperature of approximately 30° K and the shroud at approximately 80K. The supports 98 were manufactured from a "C-10 synthane" tubular material having a 3/16 inch outer diameter and a ⅛ inch inner diameter 1⅛ free length there being a total of 8. The mating faces of the second or inner stage 92 and the target 100 constitute a black honeycomb surface and each of the radiation shields 94, 96 was gold plated.

Returning for a moment to the device illustrated in FIGS. 1–9, the first stage is cooled by a low $\alpha/\epsilon$ radiator whose view to earth is partially blocked by the earth shield 35. This stage is thermally isolated from the housing 68 by radiation shields 94, 96 and a low conductance support 98. The experimental model illustrated in FIG. 10 as well as the spacecraft model illustrated in FIGS. 1 through 9, the design allows for an open band around the radiating area for the ends of the radiation shields. The radiative decoupling for the two intermediate shields provides for a low area value so that the cooled optical package can be placed on the black radiating side of the second stage so that it is not within the view of the earth or the spacecraft. The design of this invention permits a substantial reduction in the optical port loading as compared with prior art devices which is largely a result of a greater patch size to housing separation. Increase for separation results in much smaller view factors to the patch. Separation in turn is greater because the optical port is at the bottom rather than at the sides of the patch and because the support and shield system requires a greater separation between cooler stages.

The radiant cooler 34 is designed to prevent optical and thermal contamination by either the cooler components themselves or by instrument or spacecraft atmosphere. Specific provisions are provided for conditioning and decontamination for elimination of the multilayer insulation results in elimination of the internal outgasing paths and positive protection of sensitive optical components. To outgas the cooler and prevent the condensation of external contaminants from the instrument spacecraft, the cooler of this invention prior to installation in the spacecraft will be maintained at a nominal instrument temperature (22° C) for a period of about three weeks. The elimination of multilayer insulation removes the chief source of contamination within the radiant cooler. The metallic shields used in the place of the multilayer blanket have much less surface area, are easier to evacuate, and have a much lower basic outgasing rates. Internal outgassing paths are eliminated by windows 78, 80, 84 and 82 that seal the opening between the instrument 20 and the first stage 36 and between the cooler stages. A third window 84 on the radiation shield 72 nearest the second stage 58 limits the access to the volume between the shield 72 and the patch 58 to pass through the cold trap 86. The volumes within the cooler can outgas only by paths that lead directly to space. As illustrated in FIG. 9, to provide positive protection for sensitive areas, the two windows within the cooler 80, 84 will be heated 5K to 10K above their mounting temperatures and protected by cold traps 86 at the mounting temperature. The temperature difference will be sufficient to provide an order of magnitude difference in the condensation pressure between the window and trap. The outer elements on the second stage are protected by a cold trap at the patch temperature. The outer window 78 is on the cooler housing 68 which is isothermal with the main instrument 20.

The device of this invention improves the radiative coupling between stages by inserting low emissivity shields between low emissivity surfaces on the stages. This radiative decoupling is the equivalent to that of a system of floating metallic shields (see R. B. Scott, Cryogenic Engineering, D. VanNostrand Co., Inc., 1959, Section 6.4). The shields are uniformly spaced along mechanical supports between the stages. This arrangement reduces the radiative conductive (dual mode) thermal transfer between stages and eliminates the need for separate shields around the supports. The resultant insulation factor (reciprocal of the effective emissivity) between stages can be made larger than that obtained from a blanket of multilayer insulation. In addition the metallic shields are easier to evacuate and have much lower outgasing rates. As a result they are harder to contaminate and easier to decontaminate.

These principles have been demonstrated in the experimental model, illustrated in FIG. 10.

Initially the effects on the open ends 95, 97 on the radiation shields 94, 96, can be neglected. When N radiation shields, 94, 96 are placed uniformly along the supports 98 (i.e., N shields and the two boundary surfaces divide the supports into N+1 equal lengths), the radiative decoupling between stages is exactly that of N floating radiation shields. The conductive coupling is exactly that of the supports 98 connecting the two stages 90, 92. The radiative interchange between the supports 78 and the low emissivity surfaces of the shields 94, 96 and the stages can be neglected because of the relatively small surface area of the supports 98 and the small temperature differences between any support surface and the adjacent low emissivity surfaces.

Under these conditions the thermal balance equation for N shields between two stages A (90) and B (92) are given by $$\begin{array}{ccccccccccc}
2RT_1^4 & + & 2KT_1 & = & RT_a^4 & + & KT_a & + & RT_2^4 & + & KT_2 & (1) \\
2RT_2^4 & + & 2KT_2 & = & RT_1^4 & + & KT_1 & + & RT_3^4 & + & KT_3 & (2) \\
 & \vdots & & & & & & \vdots & & & & \\
2RT_j^4 & + & 2KT_j & = & RT_{j-1}^4 & + & KT_{j-1} & + & RT_{j+1}^4 & + & KT_{j+1} & (j) \\
 & \vdots & & & & & & \vdots & & & & \\
2RT_n^4 & + & 2KT_n & = & RT_{n-1} & + & KT_{n-1} & + & RT_b^4 & + & KT_b & (n)
\end{array}$$

where R is the radiative coupling coefficient between any two adjacent low emissivity surfaces and K is the conductive coupling coefficient (thermal conductance) between the same two surfaces. By substituting equation (1) into equation (2) and solving for $RT_2^4 + KT_2$ in terms of $T_a$ and $T_3$, this result can be substituted into an equation which is solved for $RT_3^4 + KT_3$ in terms of $T_a$ and $T_4$. Continuing this sequence, we finally obtain the equation $$RT_n^4 + KT_n = \frac{1}{n+1}(RT_a^4 + KT_a) + \frac{n}{n+1}(RT_b^4 + KT_b) \quad (3)$$

Now the thermal input to the patch from the supports and shields is given by $$\phi_{k+r} = K(T_n - T_b) + R(T_n^4 - T_b^4) \quad (4)$$

substituting the equation for $RT_n^4 + KT_n$ into the equation for $\phi_{k+r}$, we obtain $$\phi_{k+r} = \frac{1}{n+1}[R(T_a^4 - T_b^4) + K(T_a - T_b)] \quad (5)$$

The set of equations (1) through (*n*) also yields an expression for an intermediate shield $$RT_j^4 + KT_j = \frac{n+1-j}{n+1}(RT_a^4 + KT_a) + \frac{1}{n+1} \times (RT_b^4 + KT_b) \quad (j)$$

This can be solved for the temperature $T_j$ by successive approximations.

The conductive coupling coefficient or thermal conductance between two adjacent low emissivity surfaces is given by $$K = \Sigma \frac{K_i A_i}{li} \quad (6)$$

where $k_i$ = thermal conductivity of support $A_i$ = cross-sectional area of support $l_i$ = Length of support between adjacent low emissivity surfaces in my design, there are *m* identical supports, so that I have $$K = m\frac{kA}{l} \quad (7)$$

Moreover, $$\frac{K}{n+1} = m\frac{kA}{(n+1)l} = K_{ab}, \quad (8)$$

where $k_{ab}$ is the thermal conductance of all the supports running from stage a to stage b; that is, the thermal conductance between stages is not changed by the attachment of equally spaced radiative shields along the length of the supports.

The radiative coupling coefficient between adjacent low emissivity surfaces is given by $$R = \Sigma A_r/S_r \tag{9}$$

where $A_r$ = surface area $S_r$ = insulation factor = $(2/\epsilon_r)-1$ $\epsilon_r$ = surface emissivity The insulation factor for $n$ radiation shields between the two cooler stages is then given by $$S_{ab} = (n+1)S_r = (N+1)\left[\frac{2}{\epsilon_r} - 1\right] \tag{10}$$

This is just the insulation factor between two bounding surfaces of emissivity $\epsilon_r$ that are insulated by $n$ floating radiation shields of the same emissivity (see, for example, R. B. Scott, Cryogenic Engineering, D. Van Nostrand, 1959, p. 149).

The low emissivity surfaces are obtained by gold plating. The emissivity $\epsilon_r$ is then a function of temperature as shown in Table I. (J. G. Andronlakis and L. H. Memmerdinger, Emissivity Measurements, Final Report on Contract NAS 521760, Grumman Aerospace Corp., Nov. 29, 1972). Tests have confirmed that such emissivities can be obtained, and by measurements (in the vicinity of room temperature) on an instrument for the colorimetric measurement of hemispherical emissivity. The resultant insulation factors are given in Table II.

Table I

Total Hemispherical Emissivity of Electrodeposited Gold

| Temperature | $\epsilon_r$* |
|---|---|
| 95K | 0.031 |
| 112 | 0.033 |
| 126 | 0.034 |
| 146 | 0.035 |
| 197 | 0.038 |
| 291 | 0.045 |
| 300 | 0.046 |

*±0.002

Table II

| Temperature | $S_{ab}$ for n equal to | | | |
|---|---|---|---|---|
| (K) | 0 | 1 | 2 | 3 |
| 95 | 63.5 | 127 | 190 | 254 |
| 112 | 59.6 | 119 | 179 | 238 |
| 126 | 57.8 | 116 | 173 | 231 |
| 146 | 56.1 | 112 | 168 | 225 |
| 197 | 51.6 | 103 | 155 | 206 |
| 291 | 43.4 | 86.9 | 130 | 174 |
| 300 | 42.5 | 85.0 | 127 | 170 |

The effectiveness of the radiative shields is reduced by the increase in area as the device proceeds from the inner stage to the outer stage. On the other hand, the effectiveness is increased by the open areas at the ends. Not all of the emission from a low emissivity surface strikes the facing surface; some escapes to the cold target by way of the openings between the surfaces.

Considering first the increase in area, it is possible to calculate the decrease in the nominal shielding factor produced by an outer area larger than the inner. Assuming a shielding factor of $\epsilon_1 = 0.040$ the results are given in Table III below.

Table III

| Facing Surfaces | Outer/Inner Area | Shielding Ratio* |
|---|---|---|
| Inner - Shield 2 | 0.838 | 0.921 |
| Shield 2 - Shield 1 | 0.864 | 0.933 |
| Shield 1 - Outer | 0.879 | 0.941 |
| Average | 0.860 | 0.931 |

*For an emissivity of 0.040

Next consider the fact that all of the emission from a low emissivity surfaces does not strike the adjacent shield, (i.e., that the shields are not actually infinite in extent). The surfaces are assumed to consist of two identical plane parallel rectangles in opposite location, the flux from the first surface is absorbed by the second surface is given by formula set forth below:

$$\Phi_{1\to 2} = A_1F_{12}\Sigma T_1^4\epsilon_1\alpha_2[l + (1-\alpha_2)F_{21}(1-\epsilon_1)F_{12} + (1-\alpha_2)^2F_{21}^2(1-\epsilon_1)^2 + \ldots] \tag{11}$$

where

A = area

F = view factor

T = absolute temperature $\epsilon$ = emissivity $\alpha$ = absorptivity

The flux from the second surface absorbed in the first surface is the same expression with the subscripts 1 and 2 interchanged. In the model illustrated in FIG. 10, there exists also $F_{12} = F_{21}$, $A_1 = A_2$, and $\epsilon_1 = \epsilon_2$. Applying Kirchhoff's law it is also found that $\alpha_1 = \epsilon_1$ and $\alpha_2 = \epsilon_2$. The net flux from the first surface to the second surface is then $$\phi_{12} = \phi_{1\to 2} - \phi_{2\to 1} = A_1F_{12}\sigma(T_1^4 - T_2^4)\frac{\epsilon_1^2}{1-(1-\epsilon_1)^2F_{12}^2} \tag{12}$$

The insulation factor between surface 1 and surface 2 is then $$S_{12} = \frac{1-(1-\epsilon_1)^2F_{12}^2}{F_{12}\epsilon_1^2} \tag{13}$$

This may also be written as $$S_{12} = F_{12}\left(\frac{2}{\epsilon_1} - 1\right) + \frac{(1-F_{12}^2)}{F_{12}\epsilon_1^2} \tag{14}$$

in the limit of the infinite, plane parallel surfaces, $F_{12\to 1}$ and we obtain $$S_{12} = \frac{2}{\epsilon_1} - 1 = S_r \tag{15}$$

The view factor $F_{12}$ can be calculated from the formula given by Jakcob (Heat Transfer, Vol. 11, p. 14, John Wiley, 1957).

In my experiment a single large scale cooling stage, supported and radiatively isolated as illustrated in FIG. 10 by the multiple shield assembly, was utilized. The surfaces of the shields and the facing boundaries of the two stages were all gold plated. The results of the test are given in the Table below together with predictions based on the model as illustrated.

Table IV

| Supporting Experiment, Results and Predictions | | | |
|---|---|---|---|
| | Predicted | | |
| Conditions | Simple | With Deviations | Achieved |
| $T_a = 284.9K$ $\phi_{bl} = 0$ | 98.8K | 94.6K | 95.0K |
| $T_a = 284.3K$ $\phi_{bl} = 0.180W$ | 108.3K | 105.2K | 104.9K |
| $T_a = 284.8K$ $\phi_{bl} = 0.495W$ | 120.9K | 118.7K | 118.6K |

$T_a$ = temperature of outer stage (housing)
$\phi_{bl}$ = refrigeration load on inner stage The models assume an average emissivity of 0.040 for plated gold. It is therefore concluded that the beneficial end effects are present. Moreover, the end effects are significant. The simple model predicted an insulation factor of 147; the model illustrated in FIG. 10 produced an insulation factor of 218 including a reduction of 0.931 for unequal areas.

While the device of this invention has been illustrated in an embodiment designed for a specific spacecraft and in a theoretical model which was utilized to conduct experiments to confirm the basic operating principles of this invention, it will be appreciated by those skilled in the art that the device of this invention may take many forms while still being within the scope of the appended claims.

While the preferred examples described above are described as two cooling stage devices, it will be appreciated by those skilled in the art that if one also counts the housing there are in fact three stages. It will be understood that the radiation shielding means of this invention can be employed in the simplest form of radiant cooler which contains only one stage of cooling but counting the housing includes a total of two stages.

It will also be appreciated that only a single shield may be attached by low conductance supports between stages. In this situation especially, but in general whenever possible, the bounding surfaces of each stage that face either side of the single shield or face the outer shields in a multishield arrangement should have low emissivity surface (e.g., are gold plated).

What is claimed is:

1. Radiation shielding means for passive multiple stage radiant coolers for instruments in a housing comprising radiation shield means for each of said stages having open, externally viewing end areas including at least one shield member having a low emissivity surface evenly spaced from said housing and carried by a plurality of separate low conductive support means attached to said housing.

2. The device of claim 1 wherein said radiant cooler has a first and a second cooling stage further including a first pair of low emissivity shield members for radiatively decoupling said first stage having open, externally viewing end areas, said first members being evenly spaced from each other and said housing by a plurality of separate low conductive support means which interconnect said spaced shield members and said housing and a second pair of low emissivity shield members for radiatively decoupling said second stage having open, externally viewing end areas, said second pair of shield members being evenly spaced from each other and said first pair of shield members by a plurality of separate low conductive support means which interconnect said spaced second shield members and said first shield members.

3. The device of claim 1 wherein each of said members is a metallic shield.

4. The device of claim 2 wherein each of said members is a metallic shield.

5. A multiple stage passive radiant cooler device for cooling detector instruments in a spacecraft including:

a housing for said detector and said cooler; and radiation shielding means for each stage of said cooler for radiatively decoupling each of said stages comprising at least a pair of spaced apart low emissivity metallic shield members having open, externally viewing end areas and a plurality of separate low conductivity support and spacing means for positioning said shield members with respect to each other and for connecting them to said housing.

6. The device of claim 5 wherein said radiant cooler has a first and a second cooling stage and further includes a first pair of low emissivity shield members for radiatively decoupling said first stage having open, externally viewing end areas, said first members being spaced from each other and said housing by a plurality of separate low conductive support means which interconnect said spaced shield members and said housing and a second pair of low emissivity shield members for radiatively decoupling said second stage having open, externally viewing end areas, said second pair of shield members being spaced from each other and said first pair of shield members by a plurality of separate low conductive support means which interconnect said spaced second shield members and said first shield members.

7. The device of claim 5 wherein each of said members is a metallic shield.

8. The device of claim 6 wherein each of said members is a metallic shield.

* * * * *